United States Patent [19]

Peckston

[11] Patent Number: 4,823,410

[45] Date of Patent: Apr. 25, 1989

[54] DISPENSERS

[76] Inventor: John I. Peckston, 4 Quennell Ave., Mangere, Auckland, New Zealand

[21] Appl. No.: 907,870

[22] Filed: Sep. 16, 1986

[30] Foreign Application Priority Data

Sep. 18, 1985 [NZ] New Zealand ..... 213533

[51] Int. Cl.[4] ..... E03D 9/03

[52] U.S. Cl. ..... 4/228

[58] Field of Search ..... 4/227, 228

[56] References Cited

U.S. PATENT DOCUMENTS

| | | | |
|---|---|---|---|
| 2,045,473 | 6/1936 | Keillor | 4/227 |
| 4,171,546 | 10/1979 | Dirksing | 4/227 X |
| 4,281,421 | 8/1981 | Nyquist et al. | 4/227 X |
| 4,438,534 | 3/1984 | Keyes et al. | 4/227 |
| 4,558,471 | 12/1985 | Brown et al. | 4/228 |

*Primary Examiner*—Charles E. Phillips

*Attorney, Agent, or Firm*—Holman & Stern

[57] ABSTRACT

A dispenser comprises a body having a storage chamber to substantially retain a selected dispensable material, a dilution chamber in communication with the storage chamber, the communication being such that fluid flow from the storage chamber to the dilution chamber is restricted, an outlet from the dilution chamber with a flow controlling device associated with the outlet, and an inlet to the dilution chamber to admit fluid from outside the body to the dilution chamber. The construction and arrangement of the dispenser is such that the selected dispensable material is retained in the dilution chamber in a diluted state.

9 Claims, 4 Drawing Sheets

DISPENSERS

BACKGROUND OF THE INVENTION

1. Field of the Invention

This invention relates to dispensers.

2. Description of the Prior Art

With dispenses of, for example, the types used in toilet cisterns to apply material such as disinfectant and/or antiseptic material to the toilet bowl, some disadvantages are apparent. Usually the material simply leaches or dissolves into the cistern to be discharged with flushing water. Thus the quantity of material in the flushing water is determined by the time delay between flushes. This is unsatisfactory. Also the bulk of the material simply passes through the bowl to the drain and again the waste occassioned by this is unsatisfactory. The above devices also tend to have a life of about one week which can lead to consumer resistance because of the high repeat level of purchases.

BRIEF SUMMARY OF THE INVENTION

It is therefore an object of the present invention to provide a dispenser which will obviate or minimize the foregoing disadvantages in a simple yet effective manner which will at least provide the public with a useful choice.

Accordingly the invention consists in a dispenser comprising a body having a storage chamber to substantially retain a selected dispensable material, a dilution chamber in communication with the storage chamber, said communication being such that fluid flow from the storage chamber to the dilution chamber is restricted, an outlet from the dilution chamber, flow controlling means associated with the outlet, an inlet to the dilution chamber to admit fluid from outside the body to the dilution chamber, the construction and arrangement being such that the selected dispensable material is retained in the dilution chamber in a diluted state.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings wherein.

DETAILED DESCRIPTION

Figure 1:
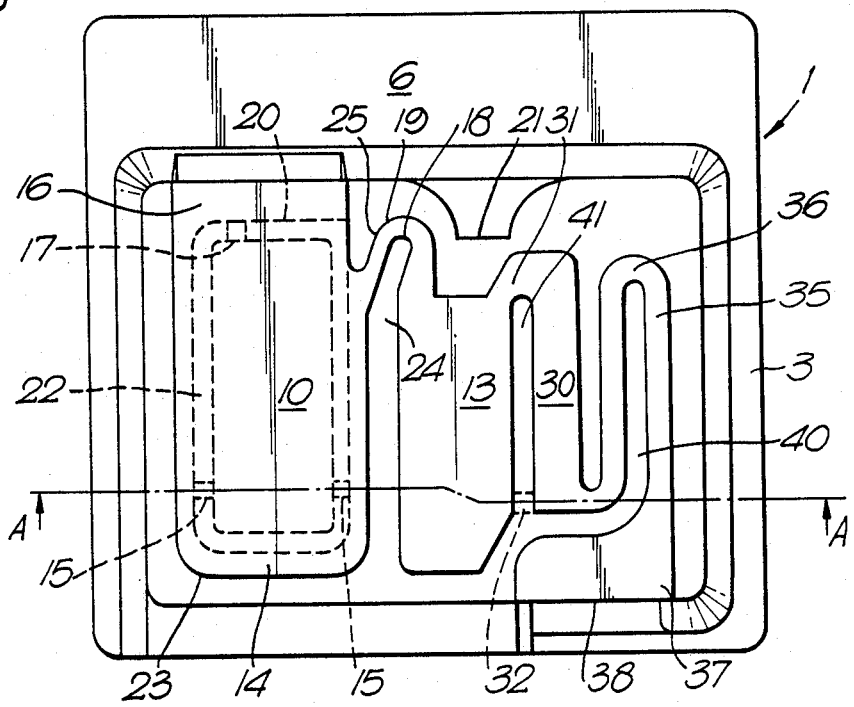
FIG. 1 is a top plan view of one form of a dispenser embodying the invention herein.
Figure 2:
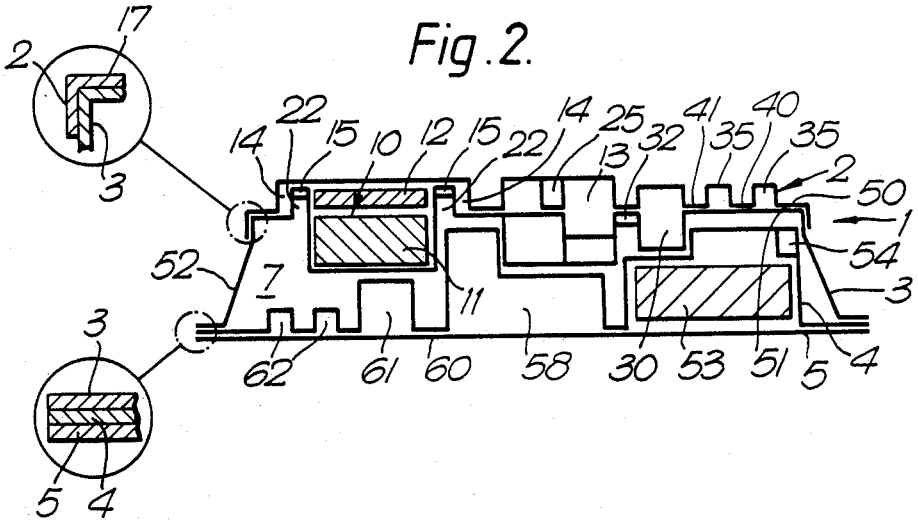
FIG. 2 is a cross-sectional view taken along line AA in FIG. 1.
Figure 3:
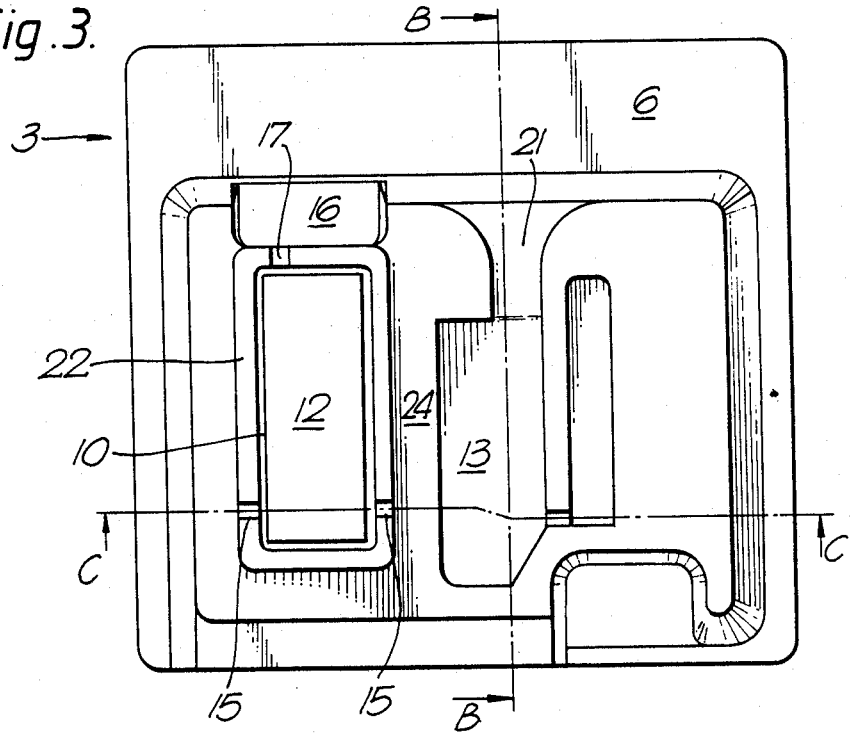
FIG. 3 is a top plan view of a central member forming part of the dispenser of FIG. 1.
Figure 4:
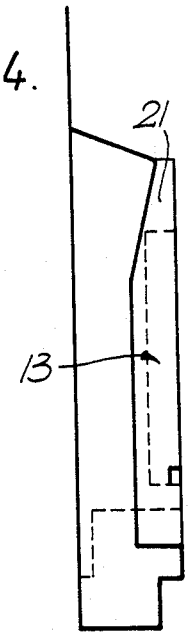
FIG. 4 is a cross-sectional view taken along line BB in FIG. 3.
Figure 5:
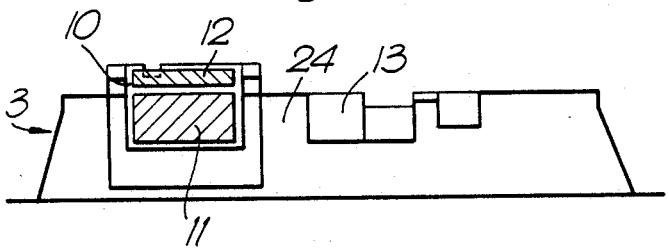
FIG. 5 is a cross-sectional view taken along line CC in FIG. 3.
Figure 6:
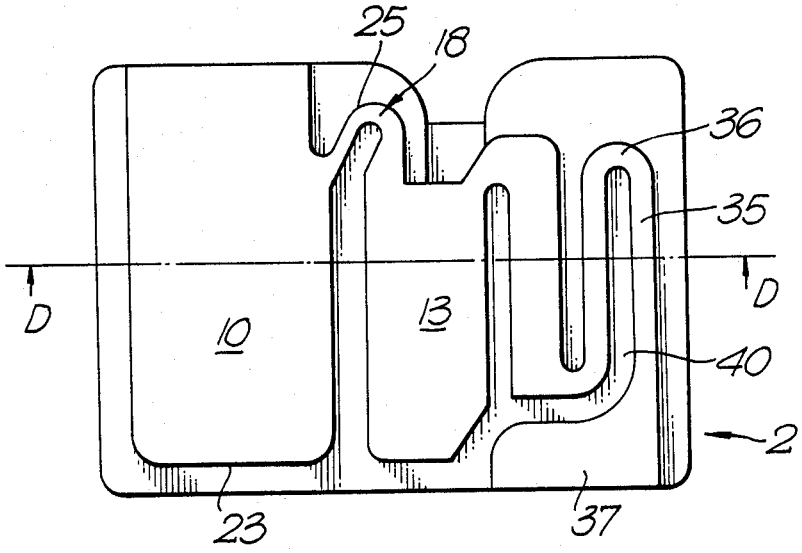
FIG. 6 is a top plan view of the front member of the dispenser of FIG. 1.
Figure 7:
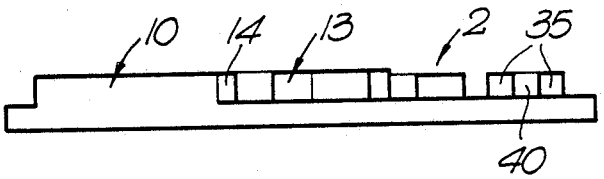
FIG. 7 is a cross-sectional view taken along line DD in FIG. 6.

Referring to the drawings, a dispenser 1 may be formed so as to provide various conduits, passageways and chambers as will be herein described. The passageways, conduits and chambers may be formed in any desired manner but in the preferred embodiment are formed from shaped plastic sheet material and this may be achieved for example by vacuum forming. Thus for example there may be a front panel 2 a central panel 3, a back panel 4 and a back cover panel 5. One of these members, for example the central panel 3, may be extended at one edge to form a sheet area 6 which can be utilized for mounting the dispenser in use. In the construction described a double dispensing system is provided, but it will be apparent that by using one half of the construction a single dispensing system is provided. It will be noted that between the panels 3 and 4 a substantial open space, indicated for example at 7 in FIG. 2, is provided. This allows in use liquid such as water to flow through a substantial part of the device therefore resisting to at least a substantial degree tendencies for air to become trapped causing the device to float.

The dispenser contained between the panels 2 and 3 will now be described. The construction includes a storage chamber 10 into which a dispensable material can be positioned. The dispensable material will be selected so as to be appropriate to the use to which the dispenser is to be put. In one embodiment the material may be intended to be dispensed or discharged into for example a lavatory bowl and in these circumstances the material may comprise for example a disinfectant and/or an antiseptic and/or a colorant and this may be provided in the form of for example a liquid, or crystals able to dissolve particularly in water, or a block, for example block 11, from which the material can leach. In the construction described the block 11 has a piece of foamed plastics material 12 positioned thereover. The construction also provides an intermediate or dilution chamber 13 which is in communication with the storage chamber 10 in a manner such that fluid flow from the storage chamber 10 to the dilution chamber 13 is of a restricted nature. To this end a conduit 14 of a relatively small aperture size is provided having openings 15 into the storage chamber 10. At the inlet end of the conduit 14 is provided a replenishment reservoir 16 which may have a further opening 17 into the upper end in use of the storage chamber 10. The chamber, conduits and the like may be formed by suitable vacuum formed shapes in the members 2 and 3 which when formed of a plastics material can be joined for example as shown at enlarged corner 17 by any suitable technique such as for example solvent welding, sonic welding or otherwise as desired. The conduit 14 continues into the dilution chamber 13 passing through an elbow or bend 18 the uppermost point on the inner surface 19 of which is below, in use, the bottom 20 of the replenishment chamber 16 so that in use during a desired time of the cycle of the device as will be described further herein liquid will flow from the replenishment chamber 16 to the dilution chamber 13.

An inlet to the dilution chamber 13 is provided for example at 21 through which air and/or liquid may move at selected times in the cycle. The chamber 10 may be formed or outlined by a raised rib 22 on center panel 3 into which the smaller entrances 15 and 17 are provided and the remainder of the conduit 14 may be defined by a raised portion 23 in front panel 2. The front panel 2 extends downwardly at 24 so that the elbow 19 is defined by a downwardly extending wall 25 in the front panel 2. It will be noted that the dilution chamber 13 is somewhat smaller in size than the storage chamber 10. An outlet is provided from the dilution chamber 13 and the outlet preferably includes a dispensing chamber 30 which is of smaller dimensions than the dilution chamber 13 and which is in communication with the dilution chamber 13 at two points. A relatively unrestricted connection is provided at an upper level at 31, for example, and a smaller, or restricted, connection is provided at the lower end for example at 32. The inlet at 21 is in communication with the passageway at 31 so that liquid, but more particularly air, interchange can take place into the dispensing chamber 30. From the dispensing chamber 30 is provided an outlet, for example by means of a conduit 35, and flow controlling means are associated with the outlet. The flow controlling means desirably comprise a siphon having its upper point at 36 and which has a discharge end at 37. It is also desirable to provide the discharge end 37 in the form of a chamber. The discharge chamber 37 is therefore shaped to provide at least one outlet 38 by which the material in the dispensing chamber 30 may be despensed into for example a toilet cistern during flushing. The passageway 35 may be defined by a downwardly extending rib 40 on the member 2 and similar downwardly extending portions around the passageway 35. The rib 40 must extend to a position above the position of the downwardly extending rib 41 between the chambers 13 and 30 so that the upper end 36 of the passageway 35 can form an airlock at the required time as will be described further herein.

The purpose of the dilution chamber 13 is to hold and mix material flowing from the storage chamber 10 in a diluted form, the dilution being achieved by means of liquid, in particular water drawn from outside the dispenser into the dilution chamber 13 through the inlet at 21. The volumn of the replenishment chamber 16 should not exceed the volumn of the dilution chamber 13 although they can be of substantially the same size, but in the preferred embodiment the volumn of the replenishment chamber 16 is somewhat less than the volumn of the dilution chamber 13.

The members 2 and 3 and also the other members herein described may be formed of a suitable plastics material such as polyvinylchloride which as stated above can be formed by vacuum molding or could be formed if desired from injection molding. The members include suitable peripheral flanges such as peripheral flange 50 on member 2 and 51 on member 3 to enable interconnections to take place. The member 3 also preferably includes a downwardly depending skirt 52 in particular to house the second dispensing system as will be described further herein. Adherence can be achieved as above described for example by gluing, radio frequency welding or otherwise as desired. Connections can be formed at all areas where for example downwardly extending ribs such as 40 and 41 bare on a flat surface and it is believed that this will be the most suitable arrangement in practice.

In use the dispenser of the invention is placed in a situation where there is a rise and fall in water levels such as for example in situations such as hydroponic or other horticultural applications, cleaning or dispensing materials in the dairy industry, and to spa pools for example as a dispensable material is able to be extraneously supplied to the storage chamber 10. If used with a substantially constant flow an apparatus is required to be introduced to induce breaks into the flow so as to enable the rise and fall required for the construction to operate. However in a particular situation the dispenser of the invention is placed into a toilet cistern so that the chamber 16 is positioned below the water level at its highest position and so that the outlet 38 is placed above the water level at its lowest position. When initially placed into the tank water will enter the chamber 16 and thereby pass around conduit 14, but will not pass over the elbow 18 because of the air break induced. Water will also enter chamber 13 through the inlet 21 and by passage through in particular the conduit 32 the water will also substantially fill the chamber 30 and the conduit 35 until an airlock forms in the elbow 36. Water will also pass through the conduit 17 into the chamber 10 and a leaching action or dissolving action will start. There will be some interchange through the conduits 15 and 17 with the water in the conduit 14 and the water in the chamber 10. Thus some of the material stored in the chamber 10 will become positioned in the conduit 14. When the toilet is flushed the water level will begin to fall and when the water level has fallen to a position at or just above the position of the siphon outlet at 38 the siphon formed by conduit 35 will begin to operate drawing diluted material contained in the chamber 30 through the siphon and into the chamber 37 where it will be taken by the flushing water as the flushing water continues to fall. Because of the restricted nature of the orifice at 32, flow through the orifice 32 is not sufficiently quick to enable emptying of the dilution chamber 13 by the siphon before the chamber 30 empties and the siphonic action will therefore cease. Thus the orifice size at 32 must be less than the minimum diameter of the conduit at 35.

The water in the dilution chamber 13 will then be replenished by water retained in the replenishment chamber 16 which will move through the conduit 14 and some material from the storage chamber 10 will be picked up through the conduit 15. The water in the chamber 16 will not completely fill the dilution chamber 13 and may for example about half fill that chamber. As the water level begins to rise in the cistern, water will begin to enter the conduit 35 from the outlet end 38 pushing air in the siphon through the dispensing chamber 30 and out through the inlet 21. During the time that the water is rising there will be also passage of the liquid leaving the dilution chamber 13 through the conduit at 32 thereby passing material into the dispensing chamber 30. Once the water level reaches the level of the inlet at 21 water will enter through that inlet into the dilution chamber 13 thereby diluting the material in that chamber and also there will continue to be passage of the water through the conduit at 32 into the dispensing chamber. Of course some water will also rise up the conduit 35 from the outlet end 38 ultimately causing an airlock at the elbow 36. Once water in dilution chamber 13 reaches the top of chamber 13, i.e. the end of conduit 18, air is trapped in conduit 18 forming an airlock at elbow 19. Once the water is the cistern reaches the level of the replenishment chamber 16, that also will refill. If desired a small chip of for example cleansing material or disinfectant, antiseptic or the like material can be placed in the chamber 30 during manufacture so that action of the dispensable material commences substantially from the first flush of the cistern.

In the construction shown in the drawings a second dispenser cistern is provided as shown in FIGS. 2 8, 9 and 10. In this construction a replenishment chamber 70 feeds through its bottom outlet 71 a storage chamber 73 into which a block 53 of leachable material such as chlorine is provided. The chlorine block 53 may rest on indentations or supports 54 and 55. An outlet 56 is provided from the storage chamber 73 passing around an elbow 57 which substantially approximates the elbow 18. A dilution chamber 58 is provided and an upper connection 59 and a lower restricted orifice 60 to a discharge chamber 61 are also provided. Again an outlet siphon passage is provided at 62 feeding a discharge chamber 63. The positioning of the elements in this construction is substantially as described for the first dispensing system. This dispensing system may be formed for example by a vacuum formed sheet 4 as before described and the chambers may be closed by the plate or cover 5, which may be adhered to the plate 4 substantially as described in the previous construction. An aperture 74 (shown in dashed lines in FIG. 8) is provided to allow replenishment of the chamber 58 during refilling of the cistern and also to allow air ingress and egress as required. It is clear from FIG. 2 that by suitably shaping the chambers in both dispensing systems they can be caused to fit back to back in an effective manner to reduce the thickness of the double dispensing system.

Figure 8:
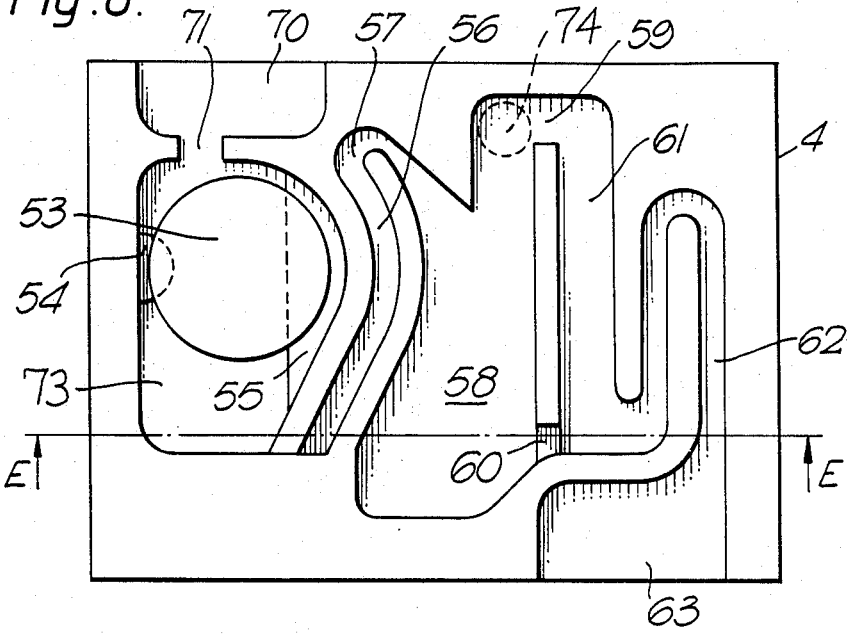
FIG. 8 is a top plan view of the back members of the dispenser of FIG. 1.
Figure 9:
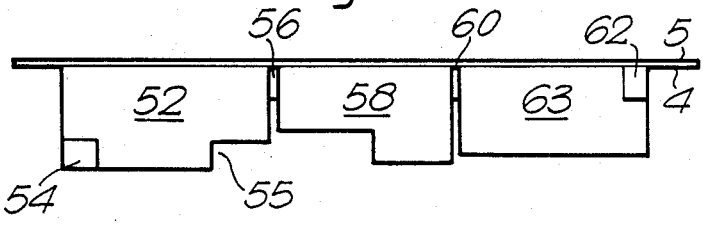
FIG. 9 is a left end elevational view of the construction of FIG. 8.
Figure 10:
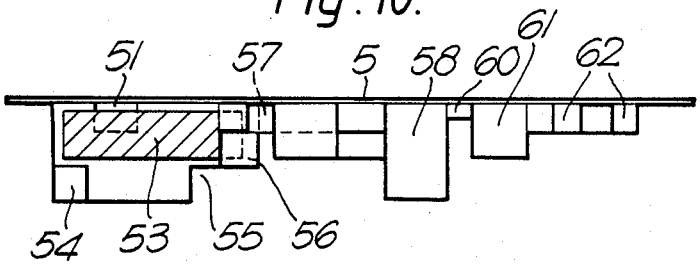
FIG. 10 is a cross-sectional view taken along line EE in FIG. 8.

In use the second dispensing system of FIGS. 8 to 10 operates in substantially the same manner as above described in relation to the first dispensing system.

Thus it can be seen that a dispenser is provided in which a substantially diluted antiseptic disinfectant cleaner or the like may be place into the bowl of a toilet with the flushing water or in which material may be dispensed in other situations having a liquid such as water flow. At least the preferred form of the invention therefore has the advantage that a reservoir of the material to be dispensed will remain available for a substantial period of time before replacement of the dispenser is required. Also the material supplied from the, or each, storage chamber 10, and/or 73, is substantially a metered amount because of the use of a dispensing chamber 30 or 61. The construction also enables in one embodiment the provision to dispense two separate dispensable materials.

It is also an advantage that the material is dispensed from the chambers 10, or 73 with the final amount of flushing water which passes from the cistern to the toilet bowl or similarly in other applications and accordingly a substantial part of the dispensed material from the dispenser will remain in the toilet bowl rather than pass from the bowl with the free flow of the flushing water.

I claim:

1. A dispenser for containing a quantity of dispensable material and dispensing a quantity of said material into a body of liquid in which the dispenser is placed when the level of the body of liquid is lowered from a first level to a second level, said dispenser comprising:

a body;

a storage chamber in said body for containing a selected dispensable material;

a dilution chamber in said body;

a passageway in said body communicating said storage chamber with said dilution chamber and having a shape for providing an air lock in said passageway;

an outlet from said dilution chamber;

flow controlling means associated with said dilution chamber outlet for controlling the flow of fluid therethrough;

an inlet to said dilution chamber for admitting fluid from the environment exterior of said body to said dilution chamber;

a replenishment chamber in said body having a top open to the environment exterior of said body and having a bottom, said replenishment chamber being shaped to be refillable from said top thereof in use and being connected with said storage chamber to facilitate fluid flow from said replenishment chamber to said storage chamber;

said passageway having an inner surface the highest point of which in normal use providing said air lock being positioned at a level below the level of said bottom of said replenishment chamber so that in use dispensable material passes from said storage chamber through said passageway past said air lock into said dilution chamber and fluid from outside said body enters said dilution chamber through said dilution chamber inlet.

2. A dispenser as claimed in claim 1 wherein:

said dilution chamber outlet comprises a dispensing chamber in said body; and communication means is provided between said dilution chamber and dispensing chamber restricting fluid flow therebetween.

3. A dispenser as claimed in claim 2 and further comprising:

a discharge chamber in said body having one end open to the environment exterior of said body; and a discharge flow channel connected between said dispensing chamber and said discharge chamber.

4. A dispenser as claimed in claim 3 wherein:

said discharge flow channel comprises a flow controlling syphon means.

5. A dispenser as claimed in claim 2 wherein:

an outlet is provided from the upper portion of said dispensing chamber communicating with said inlet to said dilution chamber.

6. A dispenser as claimed in claim 2 wherein said body comprises:

a relatively thin central member; and a relatively thin front member, said central and front members having cooperating shapes which form said chambers, passageway, inlets, outlets, communication means, conduit means and discharge flow channel, said central and front members being connected together.

7. A dispenser as claimed in claim 6 wherein:

said central and front members each have cooperating ribs for engaging the other of said members.

8. A dispenser as claimed in claim 1 and further comprising:

conduit means extending from said replenishment chamber to said dilution chamber, part of said conduit means comprising said passageway providing said air lock and receiving material from said storage chamber.

9. A dispenser as claimed in claim 1 and further comprising:

a further dispenser as claimed wherein said body is comprised of said dispensers connected together, but each dispenser operating separately and independently of one another.

* * * * *